US008684065B2

(12) United States Patent
Peterson

(10) Patent No.: US 8,684,065 B2
(45) Date of Patent: Apr. 1, 2014

(54) OVERHEAD DOOR TRACK ASSEMBLY

(76) Inventor: Carl John Peterson, New London, MN (US)

( * ) Notice: Subject to any disclaimer, the term of this patent is extended or adjusted under 35 U.S.C. 154(b) by 346 days.

(21) Appl. No.: 12/560,105

(22) Filed: Sep. 15, 2009

(65) Prior Publication Data

US 2011/0061303 A1 Mar. 17, 2011

(51) Int. Cl.
*E05D 15/20* (2006.01)

(52) U.S. Cl.
USPC ..... 160/201; 160/209

(58) Field of Classification Search
USPC ..... 160/209, 201
See application file for complete search history.

(56) References Cited

U.S. PATENT DOCUMENTS

| | | | | | |
|---|---|---|---|---|---|
| 1,921,193 | A | * | 8/1933 | Kelly | 160/209 |
| 1,948,065 | A | * | 2/1934 | Clark | 160/209 |
| 1,983,856 | A | * | 12/1934 | Johnson | 160/191 |
| 1,990,470 | A | * | 2/1935 | Clark | 160/191 |
| 1,990,870 | A | * | 2/1935 | Kelly | 160/194 |
| 2,066,558 | A | * | 1/1937 | Dautrick | 160/209 |
| 2,090,146 | A | * | 8/1937 | Pixley | 160/191 |
| 2,827,114 | A | | 3/1958 | Stroup | |
| 3,090,427 | A | | 5/1963 | Stroup et al. | |
| 4,119,133 | A | | 10/1978 | Wolf | |
| 4,250,941 | A | | 2/1981 | McNally | |
| 4,320,793 | A | | 3/1982 | Lindbergh | |
| 4,800,618 | A | | 1/1989 | Putz | |
| 5,954,111 | A | | 9/1999 | Ochoa | |
| 6,928,696 | B2 | | 8/2005 | Wartman | |

* cited by examiner

*Primary Examiner* — Blair M. Johnson
(74) *Attorney, Agent, or Firm* — Merchant & Gould P.C.

(57) ABSTRACT

An overhead door assembly includes a horizontal track, a transition track and a vertical track. The horizontal track has a first axial end and an oppositely disposed second axial end. The transition track has a first end and a second end and is curved. The first end is engaged to the second axial end of the horizontal track. The vertical track includes a first end portion and a second end portion. The first end portion is rigidly mounted to the second end of the transition track. The vertical track includes a plurality of guide portions and a plurality of jog portions that are alternately disposed along the vertical track. The plurality of guide portions and the plurality of jog portions cooperatively define a channel. The plurality of jog portions is offset from the plurality of guide portions.

19 Claims, 8 Drawing Sheets

OVERHEAD DOOR TRACK ASSEMBLY

BACKGROUND

Overhead doors are frequently used in commercial and residential facilities, as well as in the trucking industry. Due to the movement of the overhead door during opening and closing, the overhead door is not directly connected to the opening like a conventional swing style door. As a result, it can be difficult to properly seal the area around an overhead door when the door is in the closed position.

SUMMARY

An aspect of the present disclosure relates to an overhead door track assembly. The overhead door track assembly includes a plurality of guide portions and a plurality of jog portions that are alternately disposed along the vertical track. The plurality of guide portions and the plurality of jog portions cooperatively define a channel. The plurality of jog portions being offset from the plurality of guide portions.

Another aspect of the present disclosure relates to an overhead door assembly having a horizontal track, a transition track and a vertical track. The horizontal track has a first axial end and an oppositely disposed second axial end. The transition track has a first end and a second end. The first end is engaged to the second axial end of the horizontal track. The transition track is curved. The vertical track includes a first end portion and a second end portion. The first end portion is rigidly mounted to the second end of the transition track. The vertical track includes a plurality of guide portions and a plurality of jog portions that are alternately disposed along the vertical track. The plurality of guide portions and the plurality of jog portions cooperatively define a channel that is adapted to receive a plurality of rollers mounted to an overhead door. The plurality of jog portions is offset from the plurality of guide portions.

Another aspect of the present disclosure relates to a storage enclosure. The storage enclosure includes an enclosure and an overhead door assembly. The enclosure includes a top and a plurality of sidewalls engaged to the top. The top and the plurality of sidewalls define an interior. One of the plurality of sidewalls defines an opening to the interior. The overhead door assembly is disposed in the interior of the enclosure. The overhead door assembly includes an overhead door adapted for movement between an open position and a closed position, wherein the overhead door blocks access to the interior of the enclosure in the closed position. A plurality of roller assemblies is mounted to the overhead door. The plurality of roller assemblies includes a plurality of rollers. An overhead door track assembly is rigidly mounted in the interior of the enclosure. The overhead door track assembly is adapted to guide the overhead door between the open and closed position. The overhead door track assembly includes a horizontal track, a transition track engaged to the horizontal track and a vertical track engaged to the transition track. The vertical track includes a plurality of guide portions and a plurality of jog portions. The plurality of guide portions and the plurality of jog portions are alternately disposed along the vertical track and cooperatively define a channel that receives the plurality of rollers. The plurality of jog portions is offset from the plurality of guide portions in a direction toward the opening of the enclosure. The plurality of rollers of the plurality of roller assemblies is disposed in the corresponding plurality of jog portions of the vertical track when the overhead door is in the closed position A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
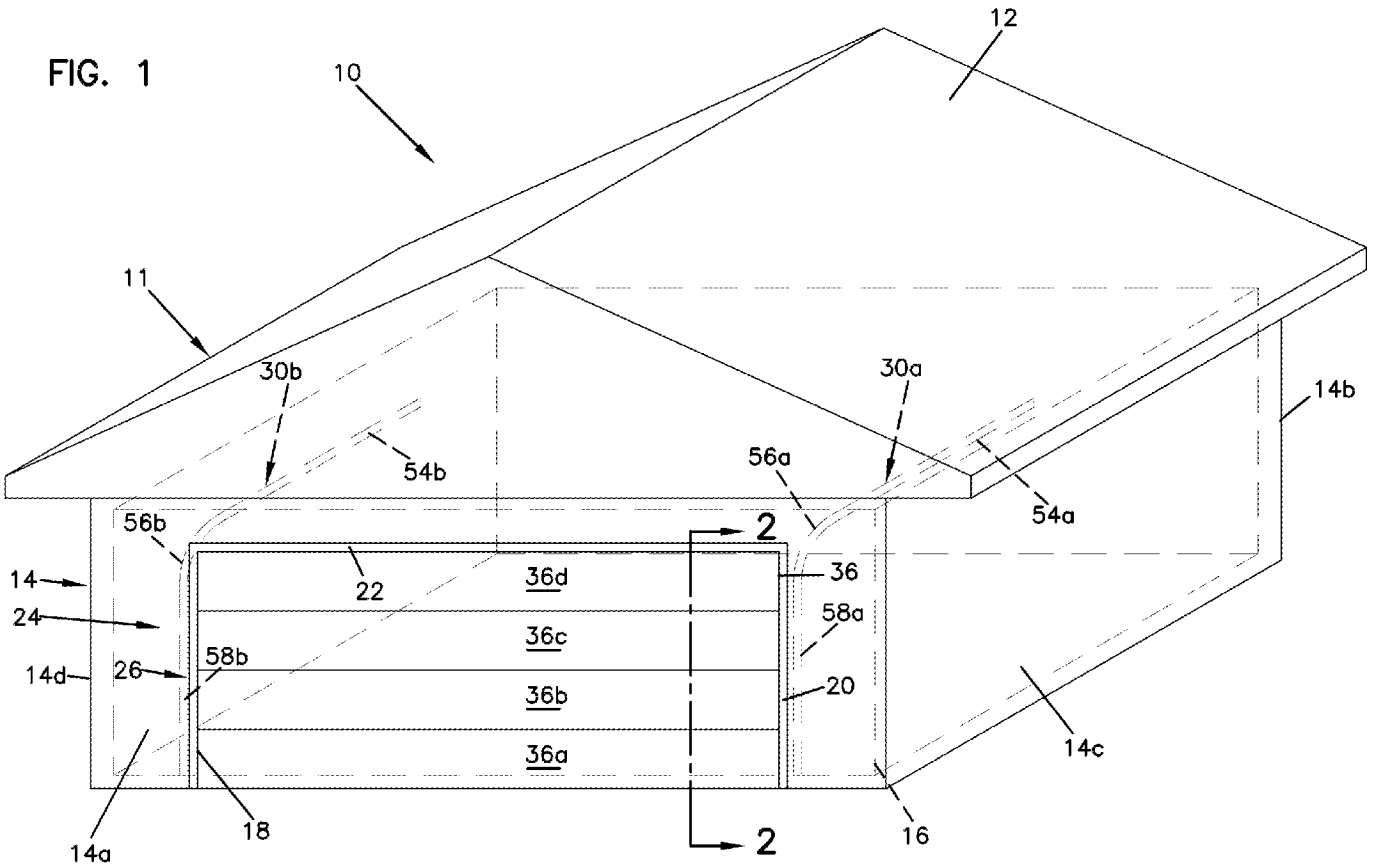
FIG. 1 is an isometric view of a storage enclosure having exemplary features of aspects in accordance with the principles of the present disclosure.

Referring now to FIG. 1, a storage enclosure 10 is shown. The storage enclosure 10 includes an enclosure 11 including a top 12 and a plurality of sidewalls 14. In the depicted embodiment of FIG. 1, the enclosure 11 is shown as a garage.

In one aspect of the present disclosure, the plurality of sidewalls 14 includes a first sidewall 14*a*, an oppositely disposed second sidewall 14*b*, a third sidewall 14*c* and an oppositely disposed fourth sidewall 14*d*. The third and fourth sidewalls 14*c*, 14*d* extend between the first and second sidewalls 14*a*, 14*b*. In one aspect of the present disclosure, the first sidewall 14*a* is a front sidewall, the second sidewall 14*b* is a back sidewall, the third sidewall 14*c* is a left sidewall and the fourth sidewall 14*d* is a right sidewall.

The top 12 and the plurality of sidewalls 14 cooperatively define an interior 16 (shown as a dashed line in FIG. 1). The interior 16 is adapted to receive items (e.g., cargo, vehicles, etc.) and to shelter these items from the outside environment.

The interior 16 of the storage enclosure 10 is accessible through an opening 18. In one aspect of the present disclosure, the first sidewall 14*a* defines the opening 18. In another aspect of the present disclosure, the first sidewall 14*a* includes a door jamb 20 and a header 22 that cooperatively define the opening 18.

Figure 2:
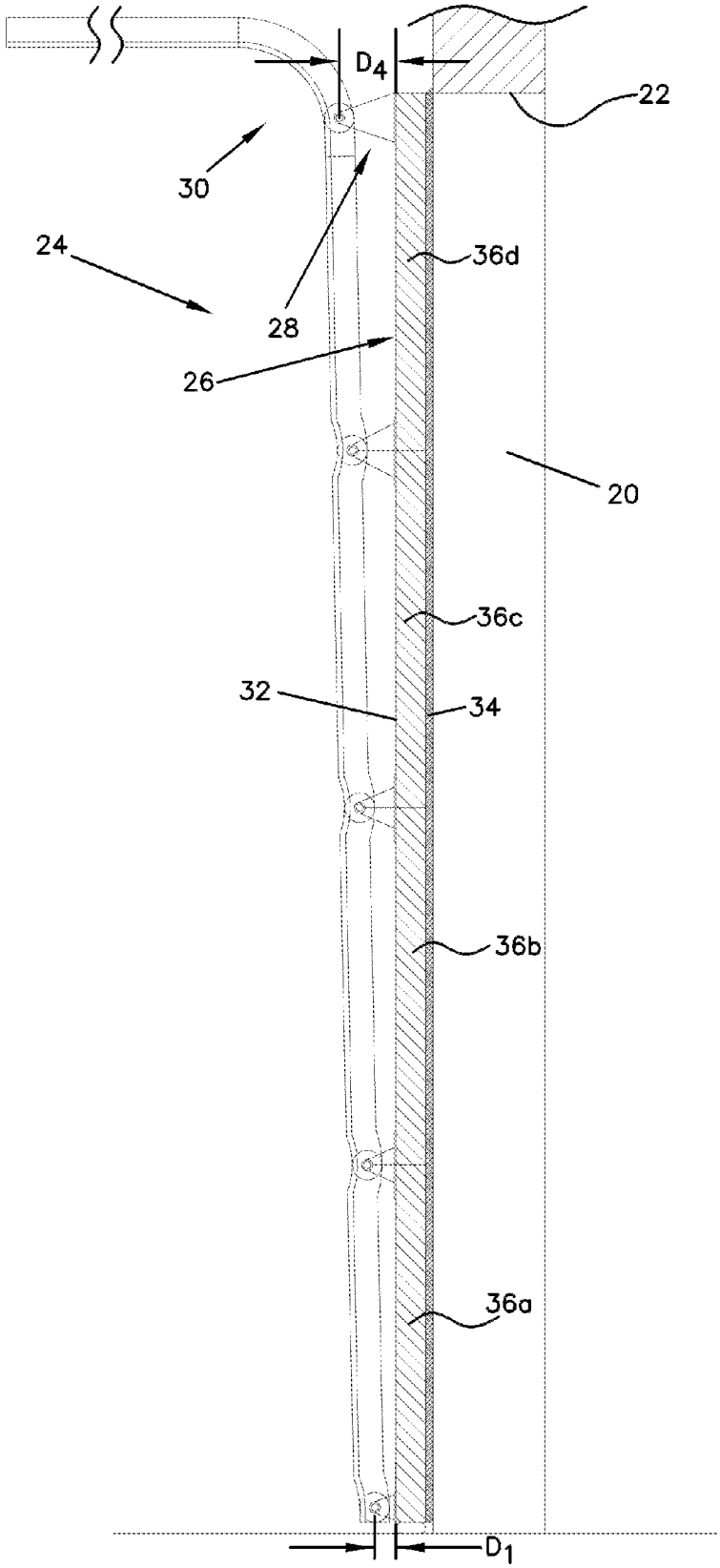
FIG. 2 is a cross-sectional view of an overhead door assembly suitable for use with the storage enclosure of FIG. 1 taken on line 2-2 of FIG. 1.
Figure 3:
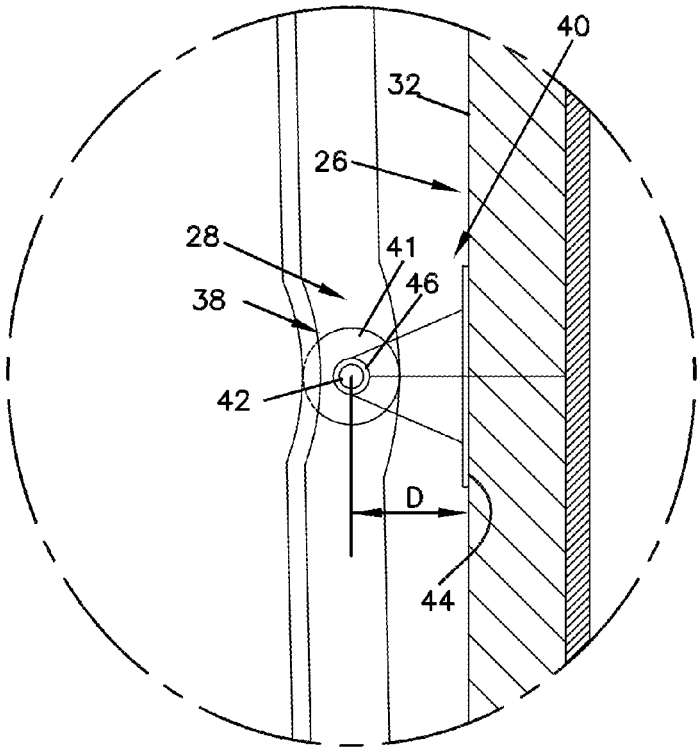
FIG. 3 is an enlarged fragmentary view of a roller assembly suitable for use with the overhead door assembly of FIG. 2.

Referring now to FIGS. 1-3, the storage enclosure 10 further includes an overhead door assembly 24. The overhead door assembly 24 includes an overhead door 26, a plurality of roller assemblies 28, and an overhead door track assembly 30.

The overhead door 26 is selectively moveable between an open position and a closed position (shown in FIG. 1). In the open position, the overhead door 26 is fully raised so that the interior 16 of the storage enclosure 10 is accessible through the opening 18. In the closed position, the overhead door 26 is fully lowered so that the opening 18 of the storage enclosure 10 is blocked by the overhead door 26 thereby blocking access to the interior 16 through the opening 18.

The overhead door 26 includes in interior surface 32 and an exterior surface 34. The interior surface 32 faces in a direction toward the interior 16 of the storage enclosure 10 while the exterior surface 34 faces in a direction away from the interior 16 of the storage enclosure 10.

In one aspect of the present disclosure, the overhead door 26 includes multiple panels 36. In the depicted embodiment of FIGS. 1 and 2, the overhead door 26 includes a first panel 36*a*, a second panel 36*b*, a third panel 36*c* and a fourth panel 36*d*. When the overhead door 26 is in the closed position (shown in FIG. 1), the fourth panel 36*d* is the upper-most panel 36 while the first panel 36*a* is the lower-most panel 36.

The plurality of roller assemblies 28 is mounted to the overhead door 26. In one aspect of the present disclosure, the plurality of roller assemblies 28 is mounted to the interior surface 32 of the overhead door 26. In the depicted embodiment of FIG. 2, the overhead door assembly 24 includes five roller assemblies 28. Each of the roller assemblies 28 includes a roller 38 and a bracket 40.

In one aspect of the present disclosure, the roller 38 includes a wheel 41 and a shaft 42. The wheel 41 includes an outer diameter that is generally greater than a width of the wheel 41. The shaft 42 is engaged to the wheel 41 at the center of the wheel 41.

The bracket 40 includes a mounting surface 44 and a roller mount 46 that extends outwardly from the mounting surface 44. The mounting surface 44 is adapted for mounting to the interior surface 32 of the overhead door 26. In one aspect of the present disclosure, the bracket 40 is mounted to the overhead door 26 by fasteners (e.g., bolts, screws, etc.).

The roller mount 46 of the bracket 40 is pivotally engaged to the shaft 42 of the roller 38. With the shaft 42 engaged to the roller mount 46, the wheel 41 of the roller 38 rotates about an axis of the shaft 42 as the overhead door assembly 24 is raised and lowered. The roller mount 46 of the bracket 40 is offset from the mounting surface 44 of the bracket 40 by a distance D. The distance D varies depending on the location of the bracket 40 on the overhead door 26. For example, the distance $D_4$ of the bracket 40 mounted on the fourth panel 36*d*, which is adjacent the header 22 when the overhead door 26 is in the closed position, is greater than the distance $D_1$ of the bracket 40 that is mounted to the first panel 36*a*. The reason for the variation in distance D will be described in greater detail subsequently.

Figure 4:
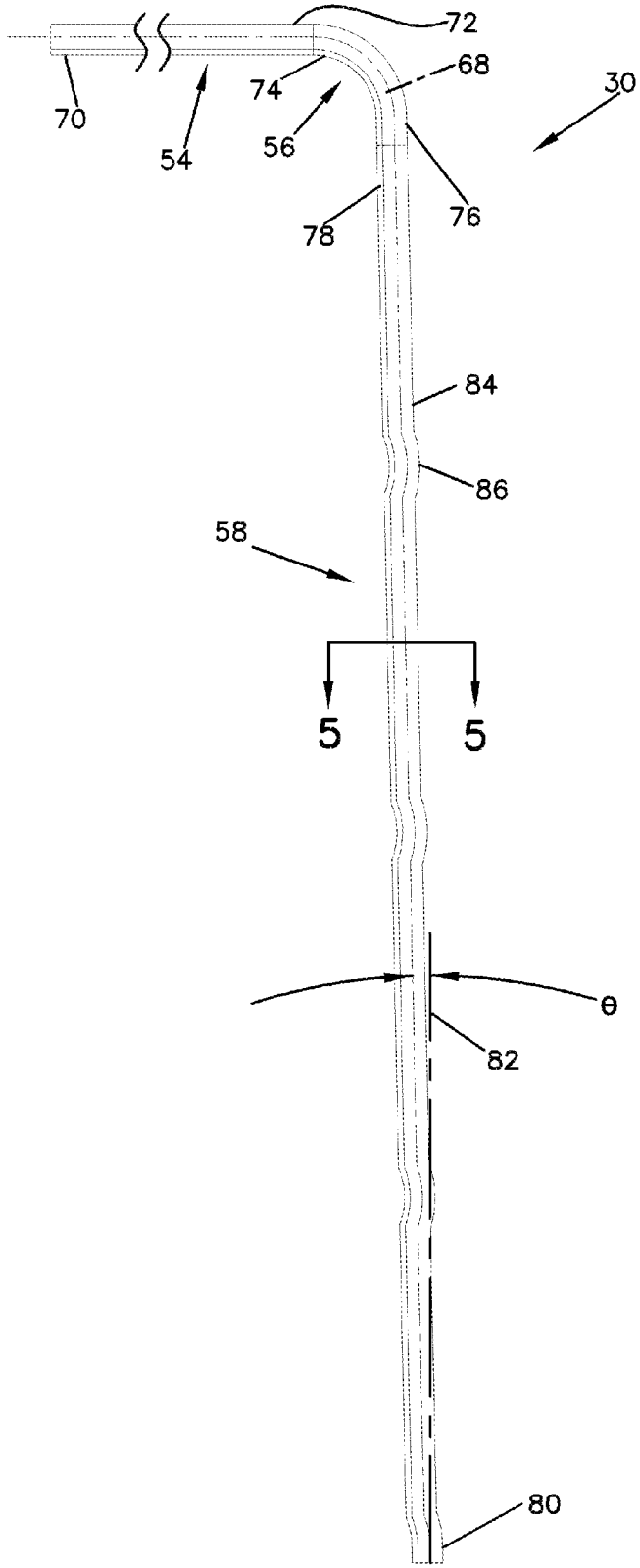
FIG. 4 is a side view of an overhead door track assembly suitable for use with the overhead door assembly of FIG. 2.

Referring now to FIGS. 1, 2 and 4, the overhead door track assembly 30 for the overhead door assembly 24 is shown. The overhead door track assembly 30 is adapted for installation in the interior 16 of the enclosure 11 of the storage enclosure 10. In one aspect of the present disclosure, the overhead door track assembly 30 is rigidly mounted in the interior 16 of the enclosure 11. The overhead door track assembly 30 receives the wheels 41 of the roller assemblies 28 and guides the overhead door 26 as the overhead door 26 is raised and lowered.

In one aspect of the present disclosure, the overhead door assembly 24 includes a first overhead door track assembly 30*a* and a second overhead door track assembly 30*b*. The first overhead door track assembly 30*a* includes a first horizontal track 54*a*, a first transition track 56*a* and a first vertical track 58*a* disposed adjacent to one side of the opening 18. The second overhead door track assembly 30*b* includes a second horizontal track 54*b*, a second transition track 56*b* and a second vertical track 58*b* disposed adjacent to an opposite side of the opening 18. As the first and second horizontal tracks 54*a*, 54*b* are substantially similar, the first and second horizontal tracks 54*a*, 54*b* will be referred to singularly and collectively as the horizontal track 54. As the first and second transition tracks 56*a*, 56*b* are substantially similar, the first and second transition tracks 56*a*, 56*b* will be referred to singularly and collectively as the transition track 56. As the first and second vertical tracks 58*a*, 58*b* are substantially similar, the first and second vertical tracks 58*a*, 58*b* will be referred to singularly and collectively as the vertical track 58.

For ease of description, portions of the overhead door track assembly 30 are referred to using the terms "horizontal" and "vertical." It is to be understood that these descriptors are for purposes of convenience only and are not intended to limit the configuration of the overhead door track assembly 30.

Figure 5:
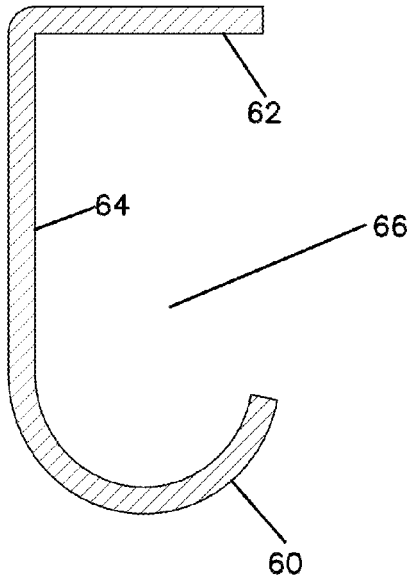
FIG. 5 is a cross-sectional view of the overhead door track assembly taken on line 5-5 of FIG. 4.
Figure 6:
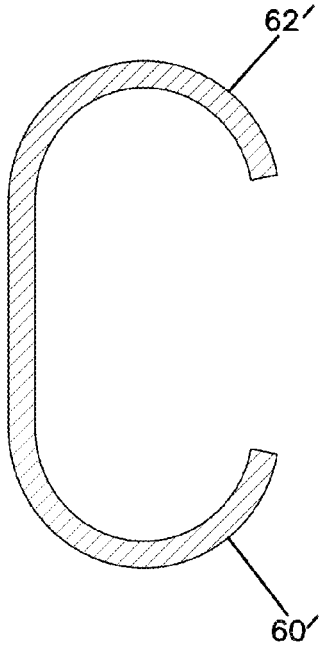
FIG. 6 is an alternate cross-sectional view of the overhead door track assembly.

Referring now to FIGS. 4-6, the cross-section of each of the horizontal track 54, the transition track 56 and the vertical track 58 includes a first edge 60, a second edge 62 and a side 64 that extends between the first and second edges 60, 62. In the depicted embodiment of FIG. 5, the first edge 60 is curved while the second edge 62 extends outwardly from the side 64 in a generally perpendicular direction. In an alternate embodiment of the cross-section of each of the horizontal track 54, the transition track 56 and the vertical track 58 depicted in FIG. 6, each of a first edge 60' and a second edge 62' is curved.

The first and second edges 60, 62 and the side 64 of the overhead door track assembly 30 cooperatively define a channel 66. The channel 66 defines a path 68 (shown as a dashed line in FIG. 3). The wheels 41 of the roller assemblies 28 are guided along at least a portion of the path 68 as the overhead door assembly 24 is raised and lowered. The path 68 extends through the center of the channel 66 in a longitudinal direction along the horizontal track 54, the transition track 56 and the vertical track 58. In one aspect of the present disclosure, the path 68 is substantially planar. The term "substantially planar" will be understood to account for deviations resulting from the manufacture and assembly of the horizontal, transition and vertical tracks 54, 56, 58.

Referring now to FIGS. 1-4, the horizontal track 54 is generally linear in shape. The horizontal track 54 includes a first axial end 70 and an oppositely disposed second axial end 72. In one aspect of the present disclosure, the horizontal track 54 is mounted in the interior 16 of the storage enclosure 10 so that the horizontal track 54 is generally perpendicular to the first sidewall 14*a*.

The transition track 56 has a generally curved shape. The transition track 56 includes a first end 74 and a second end 76. In one aspect of the present disclosure, the first end 74 is engaged (e.g., fastened, welded, etc.) to the second axial end 72 of the horizontal track 54. In another aspect of the present disclosure, the transition track 56 and the horizontal track 54 are integral.

The vertical track 58 includes a first end portion 78 and a second end portion 80. In one aspect of the present disclosure, the first end portion 78 is rigidly engaged (e.g., fastened, welded, etc.) to the second end 76 of the transition track 56. In another aspect of the present disclosure, the vertical track 58 and the transition track 56 are integral.

The vertical track 58 is rigidly mounted in the interior 16 of the storage enclosure 10 adjacent to the opening 18. In the depicted embodiment of FIG. 4, the vertical track 58 is mounted adjacent to the opening 18 so that the vertical track 58 is substantially vertical. In one aspect of the present disclosure, the vertical track 58 is disposed at an angular offset θ from a vertical reference plane 82 (shown as a dashed line in FIG. 4) that passes through the second end portion 80. As a result of the angular offset θ, a distance between the first end portion 78 of the vertical track 58 and the vertical reference plane 82 is greater than a distance between the second end portion 80 and the vertical reference plane 82.

In one aspect of the present disclosure, the angular offset θ from the vertical reference plane 82 is in the range of about 0.5° to about 1°. In another aspect of the present disclosure, the angular offset θ from the vertical reference plane 82 is greater than or equal to 0.5°. In the depicted embodiment of FIG. 2, the vertical track 58 is disposed at the angular offset θ from the first sidewall 14*a* such that a distance between the first end portion 78 and the first sidewall 14*a* is greater than a distance between the second end portion 80 and the first sidewall 14*a*.

Figure 7:
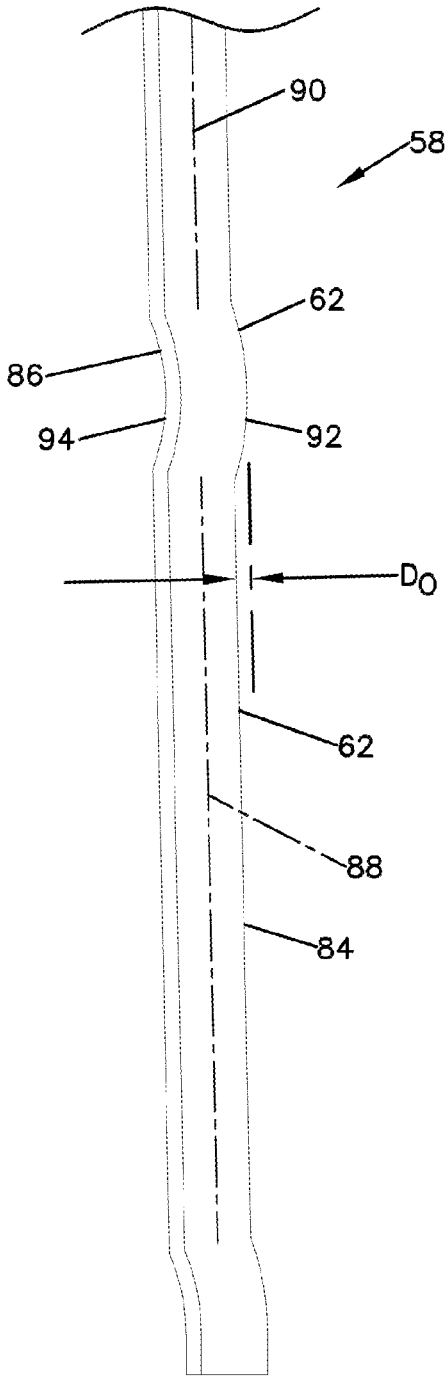
FIG. 7 is an enlarged fragmentary view of a vertical track of the overhead door track assembly of FIG. 4.

Referring now to FIGS. 2, 4 and 7, the vertical track 58 of the overhead door track assembly 30 includes a plurality of guide portions 84 and a plurality of jog portions 86. In one aspect of the present disclosure, each of the plurality of guide portions 84 is linear. The guide portions 84 cooperatively define a central longitudinal axis 88 that extends the length of the vertical track 58.

In one aspect of the present disclosure, the guide portions 84 and the jog portions 86 are alternately disposed along the vertical track 58. In one aspect of the present disclosure, the vertical track 58 includes at least three jog portions 86. In another aspect of the present disclosure, the vertical track 58 includes four jog portions 86. In another aspect of the present disclosure, the number of jog portions 86 on the vertical track 58 is equal to one less than the number of rollers 38 mounted to the overhead door 26. In another aspect of the present disclosure, the number of jog portions 86 on the vertical track 58 is equal to the number of rollers 38 mounted to the overhead door 26.

In one aspect of the present disclosure, a distance $D_J$ (shown in FIG. 8) between the jog portion 86 and an adjacent jog portion 86 is equal to a distance $D_R$ (shown in FIG. 8) between the corresponding roller 38 and a corresponding adjacent roller 38 of the overhead door assembly 24.

Referring now to FIG. 7, each of the jog portions 86 is a nonlinear portion of the vertical track 58 that can be formed or manufactured using a variety of possible techniques (e.g., pressing, cutting and bending, etc.). Each of the jog portions 86 includes an inclined portion 90 that extends outwardly from the guide portions 84 in a direction toward the opening 18 of the storage enclosure 10. The inclined portions 90 of the jog portions 86 extend outwardly from the guide portions 84 by an offset distance $D_O$. The offset distance $D_O$ is measured in a direction that is generally perpendicular to the central longitudinal axis 88 from the second edge 62 of an adjacent guide portion 84 of the vertical track 58 to an outermost portion of the second edge 62 of the jog portion 86. In one aspect of the present disclosure, the offset distance $D_O$ is in the range of about 0.125 inches to about 0.5 inches.

In one aspect of the present disclosure, each of the jog portions 86 is curved. In another aspect of the present disclosure, an outer surface 92 of the second edge 62 of each of the jog portions 86 is convex shaped (as depicted in FIG. 7) while an outer surface 94 of the first edge 60 of each of the jog portions 86 is concave shaped (as depicted in FIG. 7).

Figure 8:
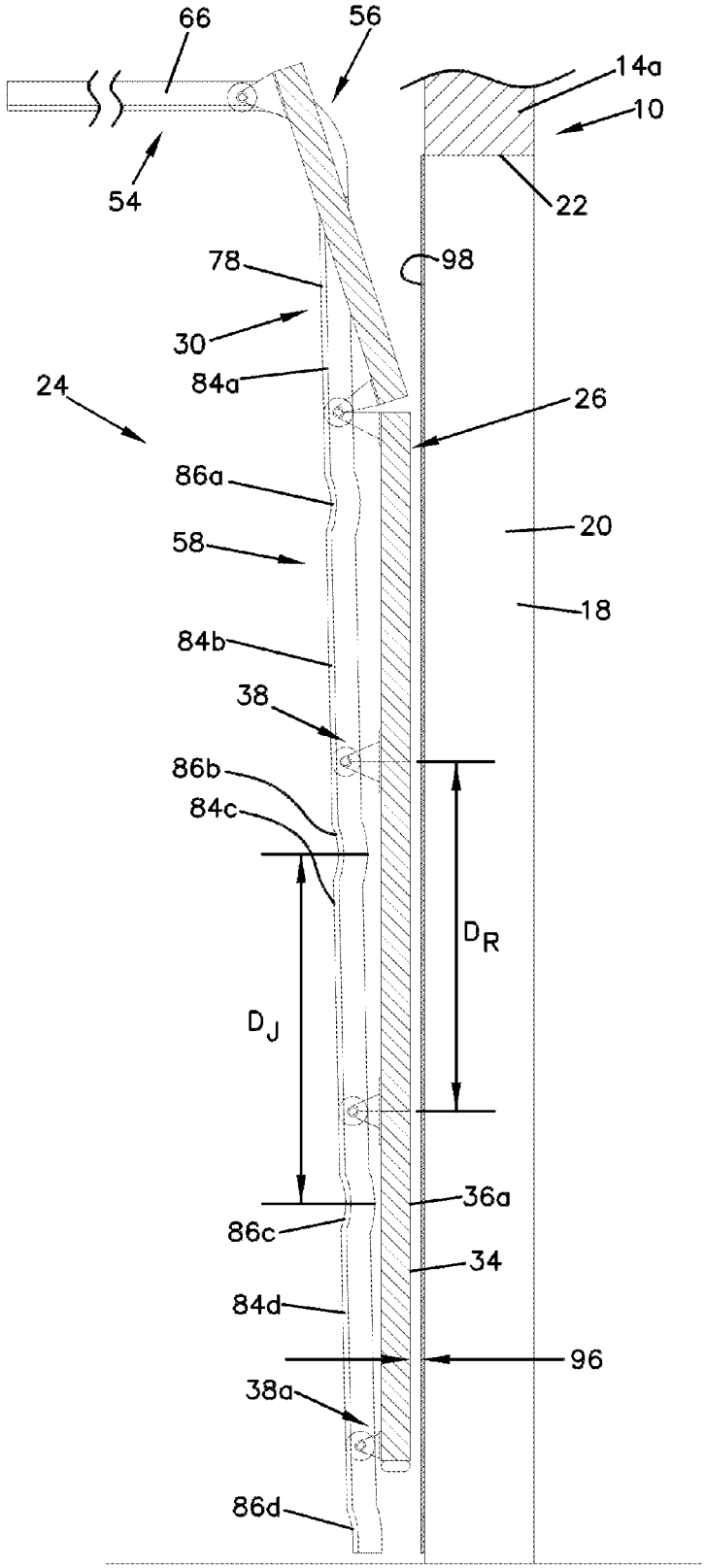
FIG. 8 is a cross-sectional view of the overhead door assembly of FIG. 2 with an overhead door in a partially opened position.

Referring now to FIGS. 2, 3 and 8, the operation of the overhead door assembly 24 will be described. With the overhead door 26 in the open position, the rollers 38 are disposed in the channel 66 of the horizontal track 54 of the overhead door track assembly 30. As the overhead door 26 is moved to the closed position, the rollers 38 follow the path 68 from the horizontal track 54 through the transition track 56 to the vertical track 58.

At the vertical track 58, a first roller 38*a*, which is engaged to the first panel 36*a* of the overhead door 26, passes through the first end portion 78 of the vertical track 58 and into a first guide portion 84*a* of the vertical track 58. As the overhead door 26 moves downwardly toward the closed position, the first roller 38*a* passes through a first jog portion 86*a*. At an outermost portion of the first jog portion 86*a*, the first roller 38*a* is displaced from the central longitudinal axis 88 of the guide portions 84 in a direction toward the opening 18 of the storage enclosure 10 by the offset distance $D_O$.

In the depicted embodiments of FIGS. 2 and 8, as the overhead door 26 moves downwardly toward the closed position, the first roller 38*a* passes through a second guide portion 84*b* of the vertical track 58, a second jog portion 86*b*, a third guide portion 84*c*, a third jog portion 86*c*, a fourth guide portion 84*d*, and a fourth jog portion 86*d*. In the depicted embodiment of FIG. 8, at least one of the jog portions (e.g., the second jog portion 86*b*) is equidistant from the adjacent jog portions (e.g., the first and third jog portions 86*a*, 86*c*) along the vertical track 58.

When the overhead door 26 is in the closed position (shown in FIG. 2), the plurality of rollers 38 is at rest in the corresponding plurality of jog portions 86. With the plurality of rollers 38 at rest in the plurality of jog portions 86, the overhead door 26 is offset from the central longitudinal axis 88 of the vertical track 58 of the overhead door track assembly 30 in a direction toward the opening 18 of the storage enclosure 10.

As the overhead door 26 moves downwardly from the open position to the closed position or upwardly from the closed position to the open position, a clearance 96 is formed between the exterior surface 34 of the overhead door 26 and an interior surface 98 of the door jamb 20. As previously provided, the vertical track 58 is disposed at the angular offset θ with respect to the first sidewall 14*a* so that the distance between the first end portion 78 and the first sidewall 14*a* is greater than the distance between the second end portion 80 and the first sidewall 14*a*. In addition, the distance $D_1$ between the mounting surface 44 and the roller mount 46 of the bracket 40 mounted to the first panel 36*a* is less than the distance $D_4$ of the bracket 40 mounted to the fourth panel 36*d*. The angular offset θ of the vertical track 58 and the distance between the mounting surface 44 and the roller mount 46 cooperatively define the clearance 96. The clearance 96 is potentially advantageous as it prevents the overhead door 26 from scrapping the door jamb 20 as the overhead door 26 is closed and opened.

With the overhead door 26 in the closed position, the clearance 96 between the exterior surface 34 of the overhead door 26 and the interior surface 98 of the door jamb 20 is significantly reduced and/or eliminated. This reduction or elimination in the clearance 96 is due to the jog portions 86 in the vertical track 58 offsetting the overhead door 26 from the central longitudinal axis 88 of the vertical track 58 in a direction toward the opening 18 in the storage enclosure 10.

This reduction in clearance 96 between the exterior surface 34 of the overhead door 26 and the interior surface 98 of the door jamb 20 is potentially advantageous as it reduces air flow between the overhead door 26 and the door jamb 20, which may result in a more energy efficient storage enclosure 10.

Figure 9:
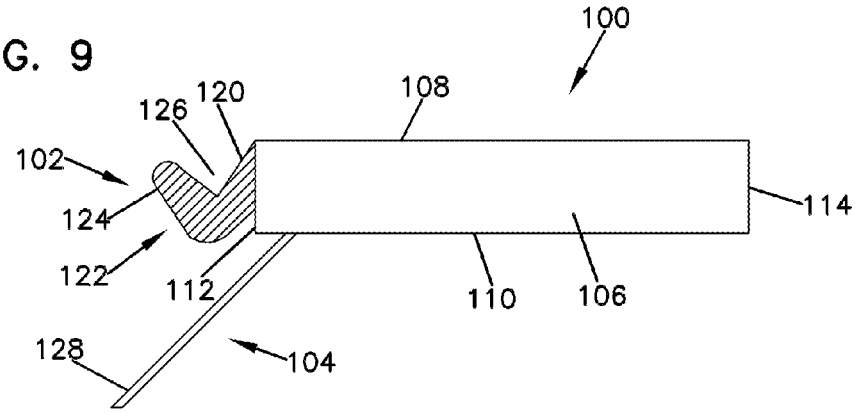
FIG. 9 is a cross-sectional view of a sealing system suitable for use with the storage enclosure of FIG. 1.
Figure 10:
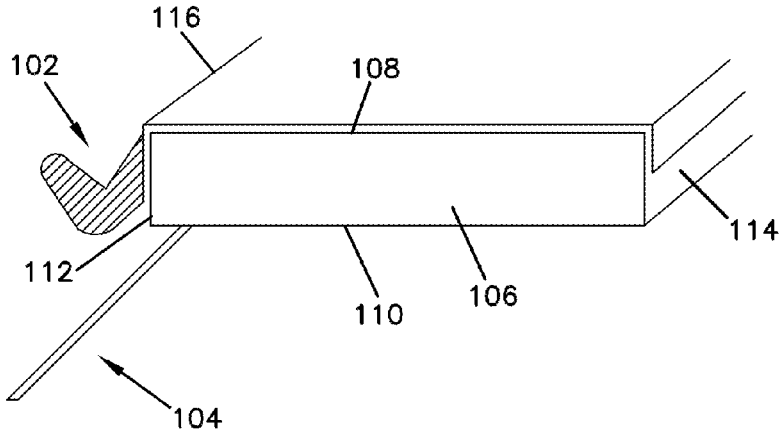
FIG. 10 is an isometric view of an alternate embodiment of a sealing system suitable for use with the storage enclosure of FIG. 1.

Referring now to FIGS. 9 and 10, a sealing system 100 is shown. The sealing system 100 includes a first sealing member 102 and a second sealing member 104.

In the depicted embodiment of FIG. 9, the first sealing member 102 is mounted to a structure 106. The structure 106 includes a first face 108, an oppositely disposed second face 110, a first side 112 and an oppositely disposed second side 114. The first and second sides 112, 114 extend between the first and second faces 108, 110. The structure 106 is fastened to the door jamb 20 of the storage enclosure 10 such that the first face 108 abuts the door jamb 20. With the first face 108 abutting the door jamb 20, the first side 112 is generally aligned with the interior surface 98 of the door jamb 20.

In the depicted embodiment of FIG. 10, the first sealing member 102 is mounted to a clip 116. The clip 116 is generally U-shaped. The clip 116 is adapted for engagement with the structure 106. In the depicted embodiment of FIG. 10, the clip 116 covers the first face 108 and at least a portion of the first and second sides 112, 114. The structure 106 and the clip 116 are then fastened to door jamb 20 of the storage enclosure 10 such that the clip 116 abuts the door jamb 20.

The first sealing member 102 includes a first end portion 120 and a second end portion 122. The first end portion 120 is fastened to the structure 106 using a fastener (e.g., tacks, nails, screws, adhesive, etc.). The second end portion 122 includes a sealing surface 124. The sealing surface 124 is adapted for contact with the exterior surface 34 of the overhead door 26 when the overhead door 26 is in the closed position. When the overhead door 26 is displaced from the closed position, the clearance 96 prevents contact between the sealing surface 124 and the exterior surface 34 of the overhead door 26.

The first sealing member 102 includes a groove 126 that extends the length of the first sealing member 102. The groove 126 is disposed between the first and second end portions 120, 122. The groove 126 allows the first sealing member 102 to flex when the overhead door 26 contacts the first sealing member 102. In one aspect of the present disclosure, the first sealing member 102 is made from a rubber material. In another aspect of the present disclosure, the first sealing member 102 is coated with a material (e.g., nylon, Teflon, etc.) that inhibits the first sealing member 102 from sticking and/or freezing to the overhead door 26.

The second sealing member 104 is mounted to the door jamb 20 at the opening 18. The second sealing member 104 includes a lip 128 that extends outwardly from the door jamb 20 toward the overhead door 26.

Figure 11:
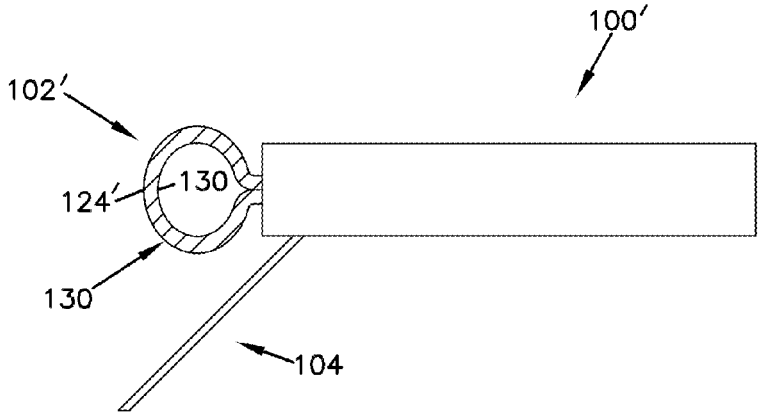
FIG. 11 is a cross-sectional view of an alternate embodiment of a sealing system suitable for use with the storage enclosure of FIG. 1.

Referring now to FIG. 11, an alternate embodiment of a sealing system 100' is shown. In this alternate embodiment, the sealing system 100' includes a first sealing member 102' and the second sealing member 104. In the depicted embodiment, the first sealing member 102' is a bulb seal. The first sealing member 102' has a generally circular cross-section and defines a bore 130 that extends through the length of the first sealing member 102'. The bore 130 allows the first sealing member 102' to compress in response to contact with the exterior surface 34 of the overhead door 26 when the overhead door 26 is in the closed position. The first sealing member 102' includes a sealing surface 124' at an outer surface 132 of the first sealing member 102' that is adapted for contact with the exterior surface 34 of the overhead door 26 when the overhead door 26 is in the closed position.

Referring now to FIGS. 1-4, a method for installing the overhead door track assembly 30 will be described. If there is an existing track assembly in the enclosure 11, the existing track assembly is removed. In one aspect of the present disclosure, it may only be necessary to remove the vertical track of the existing track assembly. The existing track assembly can typically be removed by removing fasteners that fasten the existing track assembly in the enclosure 11.

The overhead door track assembly 30 is then installed. The overhead track assembly 30 is installed by fastening the horizontal tracks 54, the transition tracks 56, the vertical tracks 58 to the interior 16 of the enclosure 11. In one aspect of the present disclosure, if only the vertical track of the existing track was removed, only the vertical track 58 of the overhead door track assembly 30 is installed.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. An overhead door track assembly adapted for use with an overhead door to cover an opening of an enclosure, the overhead door track assembly comprising:

a horizontal track having a first axial end and an oppositely disposed second axial end;

a transition track having a first end and a second end, the first end being engaged to the second axial end of the horizontal track, wherein the transition track is curved; and a substantially vertical track, the substantially vertical track:

(a) extending between a first end portion and a second end portion and defining a central longitudinal axis, the first end portion being engaged to the second end of the transition track, the substantially vertical track having a first edge, a second edge, and a side edge extending between the first and second edges;

(b) the first edge, the second edge, and the side edge cooperatively defining a single continuous channel configured to receive a plurality of rollers mounted to an overhead door;

(c) at least the first edge being shaped to define a plurality of alternately disposed straight guide portions and curved jog portions, the jog portions being axially aligned in parallel to the central longitudinal axis of the substantially vertical track, the single continuous channel being arranged and configured to receive a plurality of rollers mounted to the overhead door, the plurality of jog portions being offset from the plurality of guide portions, the plurality of jog portions offsetting the channel such that the overhead door is offset when the plurality of rollers are located in the plurality of jog portions, wherein the continuous channel is configured such that a roller of the plurality of rollers passes entirely through one or more guide portions of the plurality of guide portions and entirely through one or more jog portions of the plurality of jog portions when the overhead door is advanced between open and closed positions.

2. The overhead door track assembly of claim 1, wherein each of the plurality of guide portions is linear.

3. The overhead door track assembly of claim 1, wherein each of the plurality of jog portions includes an inclined portion that extends outwardly from an adjacent guide portion of the track.

4. The overhead door track assembly of claim 1, wherein the second edge extends outwardly from the side edge in a generally perpendicular direction.

5. The overhead door track assembly of claim 1, wherein the second edge of an outermost portion of one of the plurality of jog portions is offset from the second edge of an adjacent guide portion.

6. The overhead door track assembly of claim 5, wherein the offset is in the range of about 0.125 inches to about 0.5 inches.

7. The overhead door track assembly of claim 1, wherein the first edge, the second edge, and the side edge are each shaped to define the plurality of curved jog portions.

8. An overhead door track assembly adapted for use with an overhead door of an enclosure, the overhead door defining an opening to an interior of the enclosure, said overhead door track assembly comprising:

a horizontal track having a first axial end and an oppositely disposed second axial end;

a transition track having a first end and a second end, the first end being engaged to the second axial end of the horizontal track, wherein the transition track is curved; and a substantially vertical track having a first end portion and a second end portion, the first end portion being rigidly mounted to the second end of the transition track, the substantially vertical track having a first edge, a second edge, and a side edge extending between the first and second edges and cooperatively defining a single continuous channel therebetween and extending between the first end portion and second end portion to define a central longitudinal axis, the channel having uniform spacing between the first edge and the second edge, the continuous channel arranged and configured to receive a plurality of rollers mounted to an overhead door, the substantially vertical track including at least the side edge being shaped to define a plurality of alternately disposed straight guide portions and curved jog portions, the jog portions being axially aligned in parallel to the central longitudinal axis of the substantially vertical track, the location of each of the plurality of jog portions corresponding to the location of the plurality of rollers when the overhead door is in a closed position, the plurality of jog portions being offset from the plurality of guide portions, the plurality of jog portions offsetting the channel such that the overhead door is offset when the plurality of rollers are located in the plurality of jog portions, wherein the continuous channel is configured such that a roller of the plurality of rollers passes entirely through one or more guide portions of the plurality of guide portions and entirely through one or more jog portions of the plurality of jog portions when the overhead door is advanced between open and closed positions.

9. The overhead door track assembly of claim 8, wherein the substantially vertical track includes at least three jog portions.

10. The overhead door track assembly of claim 9, wherein at least one of the jog portions is equidistant from the adjacent jog portions along the substantially vertical track.

11. The overhead door track assembly of claim 8, wherein each of the jog portions includes an inclined portion that extends outwardly from an adjacent guide portion.

12. The overhead door track assembly of claim 8, wherein each of the plurality of guide portions is linear.

13. The overhead door track assembly of claim 8, wherein the first edge, the second edge, and the side edge are each shaped to define the plurality of curved jog portions.

14. A storage enclosure comprising:

an enclosure including a top and a plurality of sidewalls engaged to the top, the top and the plurality of sidewalls defining an interior, one of the plurality of sidewalls defining an opening to the interior;

a sealing member mounted to the enclosure at the opening;

an overhead door assembly disposed in the interior of the enclosure, the overhead door assembly including:

an overhead door adapted for movement between an open position and a closed position, wherein the overhead door blocks access to the interior of the enclosure in the closed position;

a plurality of roller assemblies mounted to the overhead door, the plurality of roller assemblies including a plurality of rollers;

an overhead door track assembly being rigidly mounted in the interior of the enclosure, the overhead door track assembly being adapted to guide the overhead door between the open and closed positions, the overhead door track assembly including:

a horizontal track;

a transition track engaged to the horizontal track; and a substantially vertical track engaged to the transition track, the substantially vertical track having a central longitudinal axis and including a plurality of guide portions and a plurality of curved jog portions axially aligned in parallel to the central longitudinal axis, the plurality of guide portions and the plurality of jog portions being alternately disposed along the vertical track, the substantially vertical track having a first edge, a second edge, and a side edge extending between the first and second edges to cooperatively define a single continuous channel that receives the plurality of rollers mounted to an overhead door, the plurality of jog portions being offset from the plurality of guide portions in a direction toward the opening of the enclosure, the plurality of jog portions offsetting the channel such that the overhead door is offset when the plurality of rollers are located in the plurality of jog portions and engaging the overhead door with the sealing member;

wherein the plurality of rollers are arranged in the single continuous channel such that a roller of the plurality of rollers passes at least partially through all of the plurality of guide portions and at least partially through all of the plurality of jog portions when the overhead door is advanced between the open and the closed positions, and wherein the plurality of rollers of the plurality of roller assemblies is disposed in the corresponding plurality of jog portions of the vertical track when the overhead door is in the closed position.

15. The storage enclosure of claim 14, wherein the enclosure is a garage.

16. The storage enclosure of claim 14, wherein the vertical track is disposed at an angular offset relative to the sidewall defining the opening.

17. The storage enclosure of claim 14, further comprising the sealing member mounted to the enclosure at the opening, the sealing member providing an environmental seal between the enclosure and the overhead door in the closed position.

18. The storage enclosure of claim 14, further comprising a second overhead door track assembly including a second horizontal track, a second transition track engaged to the second horizontal track, and a second vertical track engaged to the second transition track, the second vertical track including a second plurality of guide portions and a second plurality of jog portions, the second plurality of guide portions and the second plurality of jog portions being alternately disposed along the second vertical track, the second plurality of jog portions being offset from the second plurality of guide portions in a direction toward the opening of the enclosure.

19. The overhead door track assembly of claim 14, wherein the first edge, the second edge, and the side edge are each shaped to define the plurality of curved jog portions.

* * * * *